United States Patent [19]

Legille et al.

[11] Patent Number: 4,526,536

[45] Date of Patent: Jul. 2, 1985

[54] COOLING APPARATUS FOR USE IN CONJUNCTION WITH A CHARGING DEVICE FOR A SHAFT FURNACE

[75] Inventors: Edouard Legille, Luxembourg; Gilbert Bernard, Helmdange; Giovanni Cimenti, Fentange; Guy Thillen, Diekirch, all of Luxembourg

[73] Assignee: Paul Wurth S.A., Luxembourg

[21] Appl. No.: 560,492

[22] Filed: Dec. 12, 1983

[30] Foreign Application Priority Data

Dec. 10, 1982 [LU] Luxembourg ..... 84521

[51] Int. Cl.[3] ..... F27D 1/12

[52] U.S. Cl. ..... 432/238; 414/206

[58] Field of Search ..... 432/238, 235, 233; 414/206; 266/183

[56] References Cited

U.S. PATENT DOCUMENTS 4,273,492 6/1981 Legille et al. ..... 414/206

4,358,094 11/1982 Megerle et al. ..... 432/233

4,368,813 1/1983 Mailliet ..... 414/206

*Primary Examiner*—John J. Camby

*Attorney, Agent, or Firm*—Fishman & Dionne

[57] ABSTRACT

A water cooling apparatus is presented for use in conjunction with a charging device of a shaft furnace, particularly a shaft furnace having a bell-less top charging apparatus. The cooling apparatus essentially comprises an annular feed vat which is attached to the upper portion of a rotary shell and is movable with the rotary shell. The vat is provided with at least one opening whereby water is gravity fed from the vat through plural cooling coils positioned about a rotary jacket. An annular collecting conduit receives the water flowing from the coils. The rotary jacket supports the suspension mechanism of a distribution spout and also acts as the separating structure between the furnace interior and the component parts of the charging device.

20 Claims, 6 Drawing Figures

24
98
100
104
102
Max. 2
Max. 1
Min. 1
Min. 2
40
88
86
60
90
96
94
92
ΔH

COOLING APPARATUS FOR USE IN CONJUNCTION WITH A CHARGING DEVICE FOR A SHAFT FURNACE

BACKGROUND OF THE INVENTION

This invention relates to a cooling apparatus for use in a charging device of a shaft furnace. More particularly, the present invention relates to a novel cooling apparatus which is an improvement of the charging installation disclosed in U.S. Pat. Nos. 3,880,302 and 3,814,403.

The bell-less charging device for a shaft furnace such as described in U.S. Pat. Nos. 3,880,302 and 3,814,403, both of which are assigned to the assignee hereof and incorporated herein by reference, is well known to those skilled in the art. This type of charging apparatus is widely used because of its superior features, including its superior charging capabilites and its ability to withstand difficult operating conditions such as very high temperatures and an environment consisting of corrosive dust and other abrasive materials.

Typically, a charging device as disclosed in U.S. Pat. Nos. 3,880,302 and 3,814,403 essentially comprises a fixed feed channel positioned vertically within the center of a furnace head, a rotary shell mounted coaxially around the feed channel and a fixed outer frame mounted coaxially outside the rotary shell thereby defining a substantially annular chamber. This chamber is separated, although not isolated, from the interior of the furnace by means of a rotary disc or jacket which is integral with or rigidly connected to the rotary shell. The rotary shell and the attached disc or jacket constitute a rotary housing, with the shell being an upper housing element and the disc or jacket being a lower housing element. The charging device also includes a distribution spout which is pivotally mounted to the rotary jacket. Finally, a first driving means urges the shell, the jacket and the spout to rotate as a single unit about the vertical axis of the furnace and the feed channel while a second driving means imparts pivoting movement to the spout, independently of the movement caused by the first driving means, about the horizontal axis by which it is suspended from the housing.

Charging devices as hereinabove described have been supplied with cool inert gas circulating under pressure in order to minimize the deterioration of exposed components caused by the previously mentioned abrasive and corrosive materials. This cooling system has served a dual purpose. First, the compressed gas cools the component parts which it contacts. Secondly, as the cooling gas circulates at a higher pressure than that pressure which prevails inside the furnace, a pressurized current is directed towards the interior of the furnace and through the gaps between the fixed components and the moving component parts. This pressurized gas current prevents abrasive and corrosive dust from ascending into the annular chamber (which contains driving and/or control mechanisms).

The above described gas cooling system which is currently used has certain advantages and disadvantages. For example, as an advantage, the conventional gas cooling system does not require any additional structure in the charging installation, thereby providing initial low cost. Conversely, accessory equipment for cleaning, cooling and compressing the gas is extremely expensive while also being energy and labor intensive (such as for maintenance). Accordingly, the costs of continued operation and maintenance of a gas cooling system can become extremely expensive.

It has been suggested that one way of reducing these costs would be to replace the cooling system with a water cooling system. Unfortunately, it has heretofore been impossible to practicably construct such a workable water cooling system. The perfection of an adequate water cooling system has been particularly difficult when attempting to construct hermetically sealed and durable flow passages between the fixed component parts and the moving parts to be cooled.

SUMMARY OF THE INVENTION

The above discussed and other problems of the prior art are overcome or alleviated by the novel water cooling apparatus of the present invention. In accordance with the present invention, a water cooling apparatus for use in conjunction with a charging device, such as the charging installation disclosed in U.S. Pat. Nos. 3,880,302 and 3,814,403, of a shaft furnace is presented. The cooling apparatus essentially comprises an annular feed vat which is attached to the upper edge portion of the rotary shell. This vat has two concentric walls, i.e., an outer and an inner wall, which rotate angularly and slide axially in a sealed joint, this joint being part of an annular block affixed to the upper part of the frame of the charging device. The block is located below and is in flow communication with at least one cooling water feed pipe. The vat is also provided with at least one opening or passage whereby water is gravity fed from the vat through plural cooling coils. These coils are positioned around the rotary jacket (i.e., the lower housing), each coil being connected by a pipe to the annular vat. An annular collecting conduit is affixed to the outer frame. A rotary annular cover is associated with the collecting conduit and is attached to the rotary jacket. Pipes connect each of the coils to the collecting conduit via the rotary cover whereby the water gravity flows between the annular vat and the collecting conduit via the pipes and coils.

The passages in the annular block are preferably angularly offset in relation to the feed pipes, while the block is provided over the length of this offset with a substantially horizontal and preferably annular groove to which the cooling water flows.

The feed pipes and discharge pipes of the coils are preferably made flexible in order to compensate for thermal and mechanical deformations.

In order to enable the annular feed vat to be cleaned, an aperture is preferably provided whereby access is achieved through the top of the frame and the annular block. Also the lower surface of the movable disc or jacket is lined with insulating panels secured by refractory steel plates affixed to the jacket by means of bolts. Insulating fibers are interposed between these plates in order to eliminate "heat bridges".

An additional feature of the present invention is an insulating labrynth structure located between the outer frame and the rotary jacket which prevents dust from entering the annular chamber. As a further precaution, the pressure inside the annular chamber which is equal to the prevailing pressure in the furnace will also assist in preventing the movement of corrosive dust into the chamber.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several Figures.

DESCRIPTION OF THE PREFERRED EMBODIMENT

Figure 1:
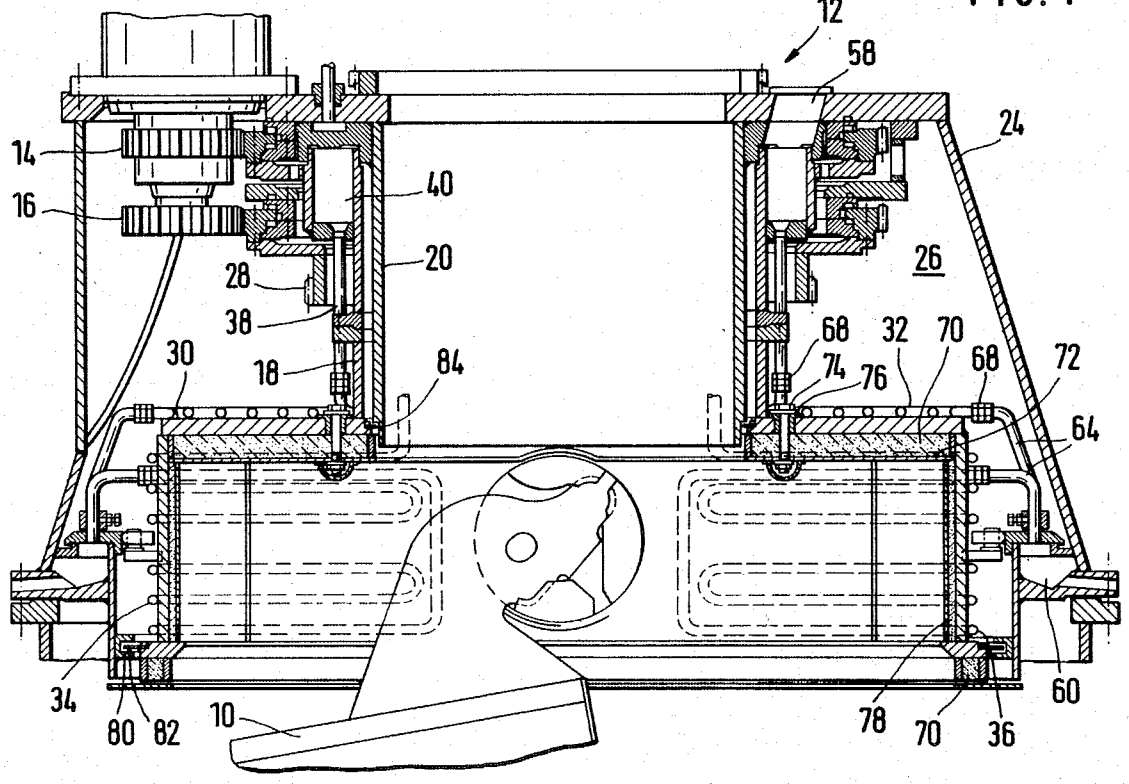
FIG. 1 is a cross sectional elevation view of a charging device incorporating the novel cooling apparatus in accordance with the present invention.

Referring first to FIG. 1, the upper portion of a distribution spout 10 is shown attached to a driving and suspension mechanism generally identified at 12. The driving and suspension system 12 is of the type described in the aforementioned U.S. Pat. Nos. 3,880,302 and 3,814,403. Accordingly, any conventional structures having been already disclosed in those Patents will be only briefly described herein.

The driving mechanism of the charging device of the present invention essentially consists of two gear trains 14 and 16 which act, respectively, to rotate a shell (upper rotary housing element) 18 about a central feed channel 20 in order to rotate the distribution spout 10 about the longitudinal axis of the furnace and to adjust the angle of the spout 10 in relation to the longitudinal axis of the furnace. Gear trains 14 and 16 are driven by first and second motors respectively (not shown). The structure to transmit movement between the gear train 16 and the axes of the suspended spout 10 consists of a toothed rim and two gear cases (also not shown but described in detail in U.S. Pat. No. 3,880,302).

An outer frame 24 surrounds the rotary shell 18 thereby forming an annular chamber 26. This annular chamber 26 is separated from the interior of the furnace by a cylindrical jacket 29 having a central opening therethrough which correspond to the feed channel 20. The jacket 29, which has a horizontal plate section **29*a* and a depending skirt section 29B, serves as a support surface for the suspension system of the spout 10. Note that the jacket 29 is integrally attached to the rotary shell 18**, both of which constitute a rotary housing.

As shown in FIG. 1, the component parts of the present invention which are directly exposed to the heat from the furnace include the walls of the jacket 29 and, to a lesser extent, the feed channel 20. In order to protect the jacket 29 from the high temperatures within the furnace, and also to prevent the associated heat from being transmitted (i.e., by conduction or radiation) to other component parts, such as the bearings and/or gearings, the jacket 29 is enclosed by a plurality of cooling coils, four of which are shown in FIG. 1 as coils 30, 32, 34 and 36. These coils are preferably supplied with gravity fed water which circulates therethrough. Each of these coils 30, 32, 34 and 36 are connected via a vertical pipe 38 which is positioned along the rotary shell 18 to an annular feed vat 40. The feed vat 40 is attached to the upper edge of the rotary shell 18 as shown in detail in FIG. 2. The coils 30, 32, 34 and 36, the vertial pipes 38 and vat 40 all rotate with shell 18.

Figure 2:
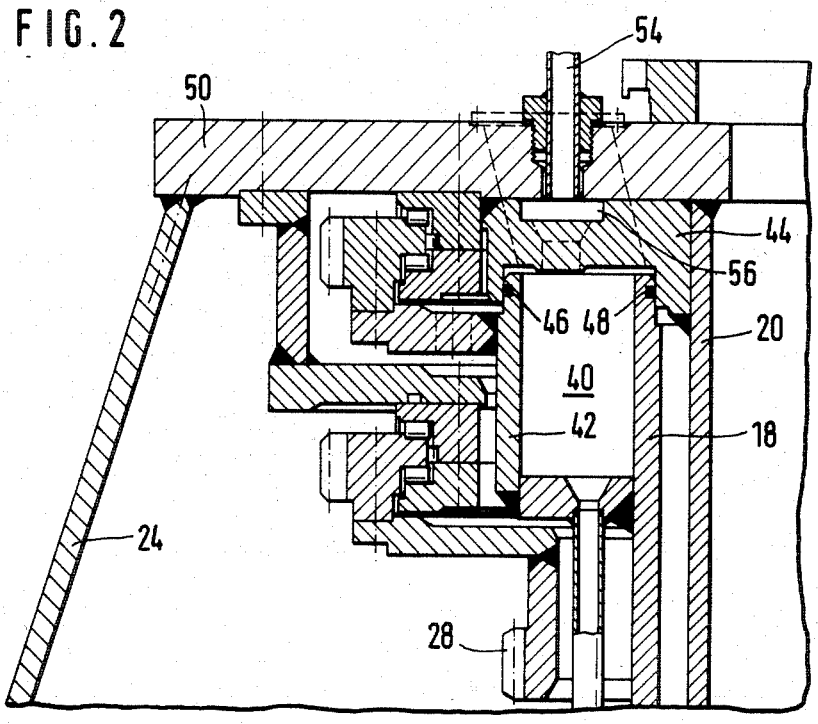
FIG. 2 is a cross sectional elevation view of an enlarged portion of FIG. 1.

Referring still to FIG. 2, the annular feed vat 40 is preferably of rectangular cross section and is formed by supplying an outer wall 42 to the shell 18 thereby defining the side edges of vat 40 therebetween and a floor 43. These side edges, in the course of spout rotation, will slide axially and rotate in an internal groove of an annular block 44. This annular block 44 is attached to the upper portion 50 of the outer frame 24. Two seals 46 and 48 between the outer edge of the vat 40 and the inner edge of the groove of block 44. The seals 46, 48 will act to prevent dust from penetrating into the vat 40. It should be understood that seals 46 and 48 are not intended to form "tight joints".

Figure 3:
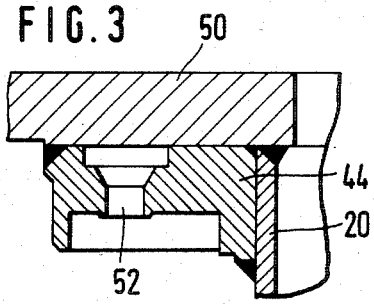
FIG. 3 is a cross sectional elevation view of the annular block of FIG. 1.

Referring now to FIGS. 2 and 3, the block 44 has a passage 52 therethrough which connects the vat 40 with a cooling water feed pipe 54. Communication between the passage 52 and the feed pipe 54 is provided through a substantially horizontal groove 56. Preferably, and especially when there is only one feed pipe 54, the horizontal groove 56 will be annular run around the entire annular block 44. Cooling water flowing within the groove 56 will then act to cool the block 44. Note that the passage 52 in the annular block 44 is preferably angularly offset in relation to the feed pipe 54.

Figure 4:
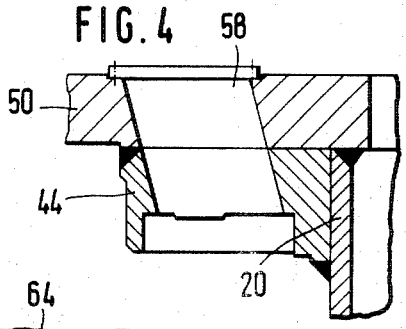
FIG. 4 is an enlarged cross sectional view of the inspection hole from the annular block of FIG. 3.

At least one access aperture 58, shown in FIGS. 1 and 4, is provided through the upper portion 50 of the frame 24 and also through the annular block 44 in order to have access to clean the vat 40.

Figure 5:
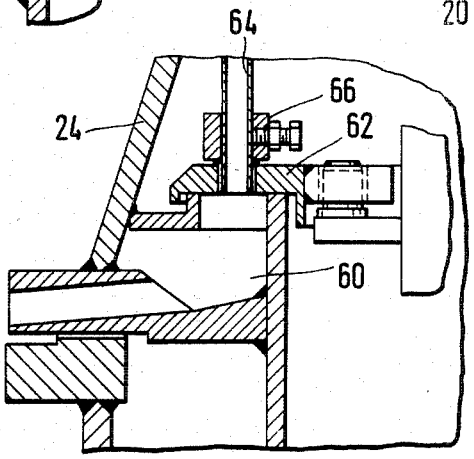
FIG. 5 is a cross sectional elevation view of another enlarged portion of FIG. 1.

Referring now to FIGS. 1 and 5, water is removed from the cooling circuits 30, 32, 34 and 36 via an annular collecting conduit 60 attached to the inner wall of the frame 24. In order to permit the jacket 29 and its attached cooling circuits to rotate, the collecting conduit 60 will preferably comprise an annular cover 62 fixed to the jacket 29. This cover 62 slides against the two opposing walls which define the entrance to collecting conduit 60 during the rotation of the jacket 29. A discharge pipe 64 (one each coming from each cooling circuit) is attached to the cover 62 by means of a connecting box 66. Thus each of the cooling circuits 30, 32, 34 and 36 are connected to the collecting conduit 60 by its discharge pipe 64. In order to compensate for thermal and mechanical deformations resulting from the extreme heat, each of the pipes 38 and 64 will preferably include a bellows type compensator 68.

As shown in FIG. 1, the lower surfaces of the plates **29*a* of the jacket 29 are lined with insulating panels 70. The insulating panels 70 are secured thereon by sheets 72 of refractory steel which are attached to the walls of the jacket 29 by means of bolts 74, insulating fibers 76 being interposed in order to eliminate the "thermal bridges" between the chamber 26 and the interior of the furnace. The insulating panels 70 are preferably about 75 millimeters in thickness. The interior of vertical skirt 29*b* of the jacket 29 may similarly be lined with insulating panels 78 which will preferably have a relatively smaller thickness of about 25 millimeters. This smaller thickness is permissible because the vertical surfaces of the jacket 29** are less exposed than the horizontal surfaces to the heat from the furnace.

Another important feature of the present invention is a protective joint structure located between the frame 24 and the rotary jacket 29. The purpose of this joint is to effectively separate the chamber 26 from the interior of the furnace. This joint will preferably consist of a circular groove 80 secured to the frame 24 and disposed across from a peripheral flange 82, the flange 82 being attached to jacket 29. Groove structure 80 and flange 82 define a labrynth seal joint. Flange 82 will continuously revolve within the groove 80 so as to prevent any appreciable amount of undesirable dust which is present or suspended in the gas, from being transmitted to the chamber 26 as a result of pressure variations in the mouth of the furnace. It is also to be noted that the movement of the dust from the furnace into the chamber 26 can be prevented or minimized by equalizing the pressure inside the chamber 26 to the pressure prevailing within the furnace. A similar labrynth seal joint structure (not shown) may also preferably be provided between the fixed channel 20 and the rotary shell 18 as illustrated by the flange 84 between the jacket 29 and the channel 20 in FIG. 1.

It may also be advantageous to provide an additional cooling circuit for the axis on which the spout is suspended. Preferably, this additional cooling circuit will be positioned in parallel with the cooling circuits 30, 32, 34 and 36 described above so that the water will similarly flow by gravity.

Figure 6:
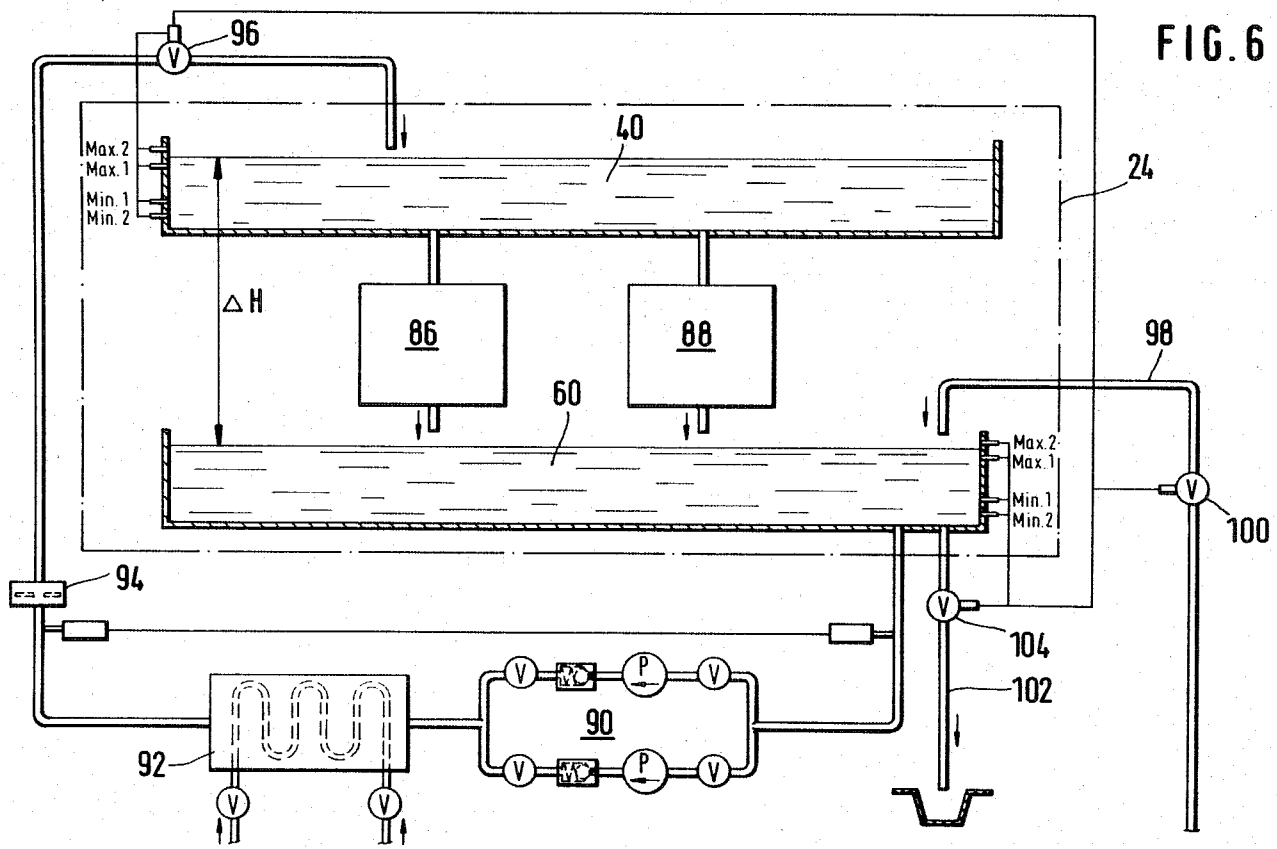
FIG. 6 is a schematic view of the cooling apparatus in accordance with the present invention.

The operation of the novel cooling device of the present invention will now be explained with reference to the schematic view shown in FIG. 6 wherein any component part already discussed has been given the same reference numeral as before. Reference numeral 24 schematically designates the frame which contains the feed vat 40 and the collecting conduit 60 therein. Between the feed vat 40 and the collecting conduit 60, the height $\Delta H$ will cause the flow of the cooling water by gravity forces. Note that the cooling circuits 86 and 88 for cooling the spouts longitudinal axis are connected between the vat 40 and the conduit 60.

The circulation of the cooling water between the collecting conduit 60 and the feed vat 40 is effected by means of a set of circulating pumps 90. Thereafter, the circulating water flows through a heat exchanger 92, a flow meter 94 and an automatic proportional valve 96. A supplementary circuit 98 having an automatic valve 100 acts to introduce additional water into the cooling circuit in order to compensate for any evaporation losses. The cooling circuit is also provided with a discharge pipe 102 having an automatic valve 104.

The circulation of the cooling water in the cooling circuit is automatically controlled by four level measuring devices associated with the feed vat 40 and four level measuring devices associated with the collecting conduit 60. Under normal operating conditions, the level in the collecting conduit 60 should be between levels min 1 and max 1. If, for some reason, the water level falls to min 1, an alarm signal is produced therefrom and the supply of water is automatically replenished to the automatic valve 100 and line 98. If the water level continues to fall, the pumps 90 are automatically stopped at level min 2 so as to prevent them from rotating idly. When the water level rises as a result of the water supplied through the pipe 98, the valve 100 is automatically closed at the level max 1. If despite the closing of the valve 100, the level of water continues to rise, the valve 104 is automatically opened by the max 2 sensor whereby water will flow through the discharge pipe 102 thereby preventing water overflow into the furnace.

In the vat 40, the water level under normal operating conditions must be between the levels min 1 and max 1. If the level descends to min 1, a signal from sensor min 1 will cause the pumps 90 to be activated and the valve 96 to be completely opened. As soon as the rising level reaches the mark max 1, a signal from the max 1 sensor will cause the proportional valve 96 to slowly reduce the flow and cause a progressively corresponding reduction in the rate at which the pumps 90 are operating. When the level reaches the threshhold max 2, a signal from the max 2 sensor will cause the valve 96 to completely close and the pumps 90 will automatically shut off.

Under normal operating conditions of the present invention, the cooling water level should not fall below min 1 in vat 40. But, if the level nevertheless does fall below the mark min 1, then the automatic valve 100 will open in order to replenish the water supply through the conduit 60. The water level should then once again rise in the vat 40 as a result of the pump action. If despite the fresh supply of water through the pipe 98 and the operation of the pumps 90, the level in the vat 40 continues to fall, an alarm signal set to go off at the mark min 2 will indicate that there is a probable leakage in one of the cooling units 86 and/or 88. Accordingly, under normal operating conditions, the levels min 2 must never be reached in either the feed vat 40 or in the collecting conduit 60, and similarly, the levels max 2 must never be exceeded in either the vat 40 or the conduit 60. Note that if the water levels do pass these marks, this will indicate that an operating failure such as a leak exits either in the vat 40, the conduit 60 or in one of the cooling units 86 or 88 exists.

For the sake of clarity, the following is a summary of the path taken by the cooling liquid while flowing through the colling apparatus shown in FIGS. 1–5.

First, the water or other cooling liquid is gravity fed to the feed pipe 54 and is then delivered to the annular groove 56 wherein it cools the annular block 44. It will be understood that other feed pipes may also be provided to deliver liquid to the groove 56. Next, the cooling liquid flows from the annular groove 56 through the preferably angularly offset passage 52 and into the annular feed vat 40. Thereafter, the cooling liquid exits from the feed vat 40 through at least one vertical pipe 38 and into the preferably plural cooling coils 30, 34, 34 and 36. Emerging from the cooling coils, the liquid is gravity fed down to the collecting conduit 60 via discharge pipes 64. Finally, from the collecting conduit 60, the now heated cooling liquid is cooled by pumping it through the heat exchanger 42 ad back into the feed pipe 54 wherein the just summarized flow circuit is repeated. It will be understood that throughout the flow circuit, all of the apparatus except for the collecting conduit is rotating with respect to the furnace axis, and in response to the aforementioned motors and gearing trains. Moreover, it will be understood that the liquid flowing through the annular groove 56, annular feed vat 40 and anular collecting conduit 60 travels around the entire housing, i.e., rotary shell 13 and jacket 29.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A cooling apparatus for use in conjunction with a charging device of a shaft furnace, said charging device comprising a fixed feed channel positioned vertically about an axis of said furnace, a rotary housing mounted coaxially around said feed channel, said rotary housing having first and second sections, a fixed outer frame mounted coaxially about said first houding section, a distribution spout being pivotally mounted to said second housing section, first driving means which urges said housing and spout to rotate as a single unit about said furnace axis and said feed channel, and a second driving means which causes said spout to pivot about the axis by which it is suspended from said second housing section, said cooling apparatus including:

annular feed vat means attached to said rotary shell;

feed pipe means connected to at least one opening in said fed vat means whereby cooling water is gravity fed therethrough into said vat means;

at least one cooling coil attached to said second housing section;

connecting pipe means providing communication between said vat means and said cooling coil whereby cooling water may be gravity fed therethrough;

collecting conduit means fixed to the bottom portion of said outer frame; and second connecting pipe means providing communication between said cooling coil and said collecting conduit means whereby water gravity flows between said annular fed vat means and said collecting means.

2. The apparatus of claim 1 wherein said feed vat means is comprised of:

a first concentric wall and a second concentric wall, said first and second concentric walls having first and second side edges respectively.

3. The apparatus of claim 1 including:

an annular block fixed to said outer frame.

4. The apparatus of claim 3 wherein said feed vat means is comprised of:

a first concentric wall and a second concentric wall, said first and second concentric walls having first and second side edges respectively.

5. The apparatus of claim 4 wherein said block includes:

an annular internal groove capable of communicating with said first and second side edges whereby said side edges will slide therein.

6. The apparatus of claim 5 including:

a pair of seals disposed between said side edge of said vat means and said internal annular groove whereby dust is prevented from entering said vat.

7. The apparatus of claim 1 including:

means for permitting rotational movement between said second housing section and said collecting conduit means.

8. The apparatus of claim 7 wherein said means for permitting rotational movement between said second housing section and said collecting conduit means includes:

a rotary annular cover means fixed to said second housing section and disposed above said collecting conduit means whereby said conduit means is capable of sliding along said cover means.

9. The apparatus of claim 3 wherein:

said opening provided between said pipe means and said feed vat means is located through said annular block.

10. The apparatus of claim 9 wherein:

said opening through said annular block is angularly offset relative to said feed pipe means.

11. The apparatus of claim 3 including:

an annular groove, said groove running around said annular block, said groove located between said feed pipe means and said opening whereby cooling water is allowed to flow therethrough.

12. The apparatus of claim 1 including:

means for permitting rotational movement between said second housing section and said collecting conduit means.

13. The apparatus of claim 1 wherein:

at least one of the feed pipe means, first connecting pipe means and second connecting pipe means are comprised of a flexible material whereby thermal and mechanical deformations are compensated therefore.

14. The apparatus of claim 1 including:

at least one access aperture through the upper portion of said outer frame providing communication to said vat means.

15. The apparatus of claim 1 including:

insulating panel means provided on the surface of said second housing section.

16. The apparatus of claim 14 including:

refractory steel plates securing said panel means to said second housing section by bolt means.

17. The apparatus of claim 16 including:

insulating fibers interposed between said jacket, bolt means and refractory steel plates thereby eliminating thermal bridges.

18. The apparatus of claim 1 including:

at least a first level indicator means associated with said vat means; and at least a second level indicator means associated with said collecting conduit means thereby providing automatic leak detection and water level control.

19. The apparatus of claim 1 including:

protective joint means located between the bottom portion of said frame and said second housing section whereby dust is prevented from transmittal to said chamber.

20. The apparatus of claim 19 wherein said joint means includes:

a circular groove secured to said frame; and a flange attached to said jacket, said flange disposed across from said groove whereby said flange continually revolves within said groove.

* * * * *